United States Patent [19]

Lindberg

[11] Patent Number: 5,040,572

[45] Date of Patent: Aug. 20, 1991

[54] REVETMENT MATTRESS

[75] Inventor: Mark H. R. Lindberg, Pymble, Australia

[73] Assignee: Foreshore Protection Pty Limited, New South Wales, Australia

[21] Appl. No.: 337,763

[22] PCT Filed: May 25, 1988

[86] PCT No.: PCT/AU88/00158

§ 371 Date: Mar. 13, 1989

§ 102(e) Date: Mar. 13, 1989

[87] PCT Pub. No.: WO88/09404

PCT Pub. Date: Dec. 1, 1988

[30] Foreign Application Priority Data

May 25, 1987 [AU] Australia ..... PI2125

[51] Int. Cl.[5] ..... D03D 11/00; E02B 3/12

[52] U.S. Cl. ..... 139/410; 405/18; 405/19

[58] Field of Search ..... 405/18, 19; 139/410

[56] References Cited

U.S. PATENT DOCUMENTS

| | | | |
|---|---|---|---|
| 3,008,213 | 11/1961 | Foster et al. | 139/410 |
| 3,048,198 | 8/1962 | Koppelman et al. | 139/410 |
| 3,517,707 | 6/1970 | Hages et al. | 139/410 |

*Primary Examiner*—James C. Cannon
*Attorney, Agent, or Firm*—Henry M. Bissell

[57] ABSTRACT

A revetment mattress for preventing the erosion of earthen structures comprising a revetment fabric having a pair of layers of flexible pervious plastic material interconnected by intermittent and staggered spacer threads. This structure has the ability to maintain the layers in a substantially parallel relationship once the mattress has been injected with filler material.

2 Claims, 2 Drawing Sheets

REVETMENT MATTRESS

The present invention relates to a novel, improved revetment fabric and to its use as a revetment mattress, in erosion control.

Revetment fabric consists of two layers of fabric either woven, in part, together or held in parallel relationship by spacer threads. The three types of revetment mattress are:

(a) filter point—wherein the two layers of fabric are woven together at spaced points through which the water in the concrete slurry is expelled giving a cobblestone appearance to the mattress;

(b) uniform cross section—wherein the two layers of fabric are held in parallel relationship by spacer threads giving a pillow or buttoned appearance to the mattress; and (c) collapsible constant thickness—wherein the two layers of fabric are woven together in longitudinal strips with optional transverse weaving to give a parallel column or pillow appearance to the mattress. Longitudinal threads extend through the woven sections and through any transverse weaving and allow the column or pillow to collapse or fold about the adjacent column or pillow, should ground subsidence occur.

All of the above types of revetment mattress come in a range of sizes of about 50 mm to about 600 mm, being the approximate set thickness of concrete within the revetment mattress.

Revetment mattresses are used in a wide range of erosion control applications from ocean breakwaters to lining drainage channels and ditches; and to be effective, the revetment mattress must be able to withstand nature's forces such as wave action, ice formation and soil movement. The weakest part of a revetment mattress, and the place where cracking or breakage of the concrete will occur is obviously where the concrete is at its thinnest.

Regardless of the type of revetment mattress chosen, and this will depend on the particular site requirements, there will always be parts of the concrete mass which are thinner than surrounding parts. This is particularly marked on steep corners of a ditch or culvert where the fabric is folded and the pillow or buttoned appearance is extreme, as shown in attached FIG. 1.

In addition, as the strength of the overall mattress is not dependant on the thickest cross-section of concrete in the mattress but rather on achieving a uniform cross-section; it follows that any substantial pillowing or buttoning appearance to the mattress is only excess concrete.

In previous attempts to achieve a uniform cross-section a 100 mm uniform cross-section revetment fabric was used. However, this had the major disadvantage that it was impossible to pump concrete into the mattress without first cutting several spacer threads every few meters to form a large enough hole in the mattress to insert the pump nozzel. Often around these cut sections, concrete was not set and water could under-flow the mattress defeating its very purpose.

The present invention seeks to substantially overcome the above disadvantages and provide a substantially uniform cross-section of concrete within a revetment mattress.

In one broad aspect of the present invention there is provided a revetment fabric comprising two layers of flexible pervious material characterised in having at least one lengthwise spacer thread intermittently and alternatively woven in each layer, to form an angled connection between each layer and maintain the layers in a parallel relationship.

Preferably there are six lengthwise spacer threads intermittently and alternatively woven in each layer to form a scissor connection between each layer. More preferably, the woven section of spacer threads is in staggered relationship with an adjacent row of spacer threads. In known revetment fabrics the woven section is linear and cracking of the concrete could occur. The staggered woven sections act to prevent cracking by giving a more linear appearance to the mattress.

The present invention will now be described with reference to the attached drawings in which.

Figure 1:
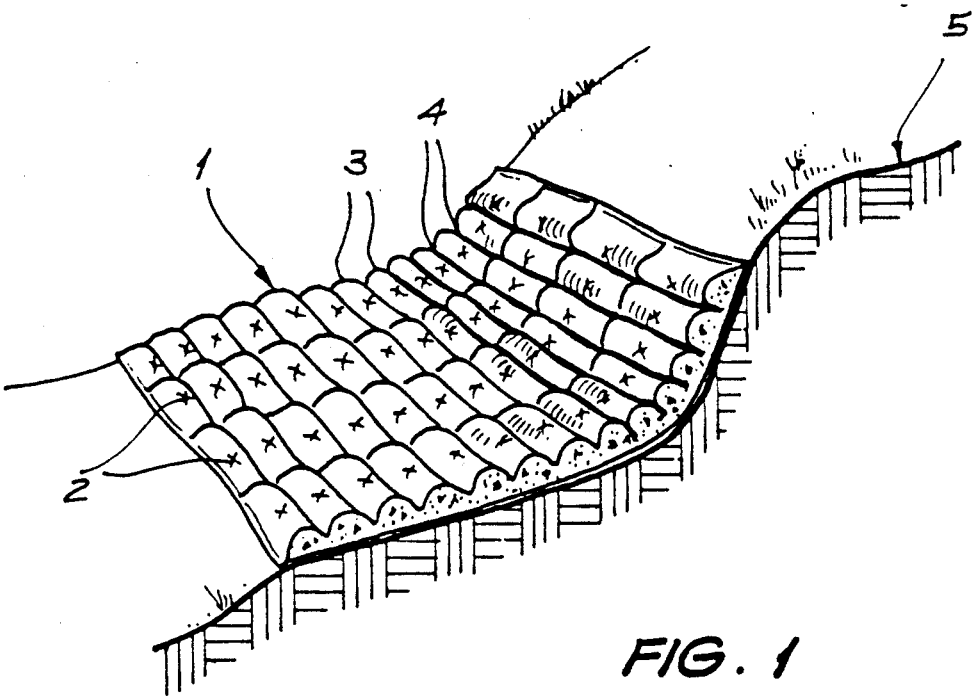
FIG. 1 PRIOR ART
FIG. 1 is a schematic view of a known uniform cross-section revetment mattress fabric in situ.

In FIG. 1, on an embankment 5 is shown the revetment mattress 1, of known uniform cross-section type. The location of the spacer threads is shown at 2 and the resulting pillow 3 is clearly shown. As can be seen, the depression 4 between pillow 3 is quite marked particularly in the steeper curvature of the embankment 5, and it is in this depression 4 that any cracking or breaking of the concrete will occur.

Figure 2:
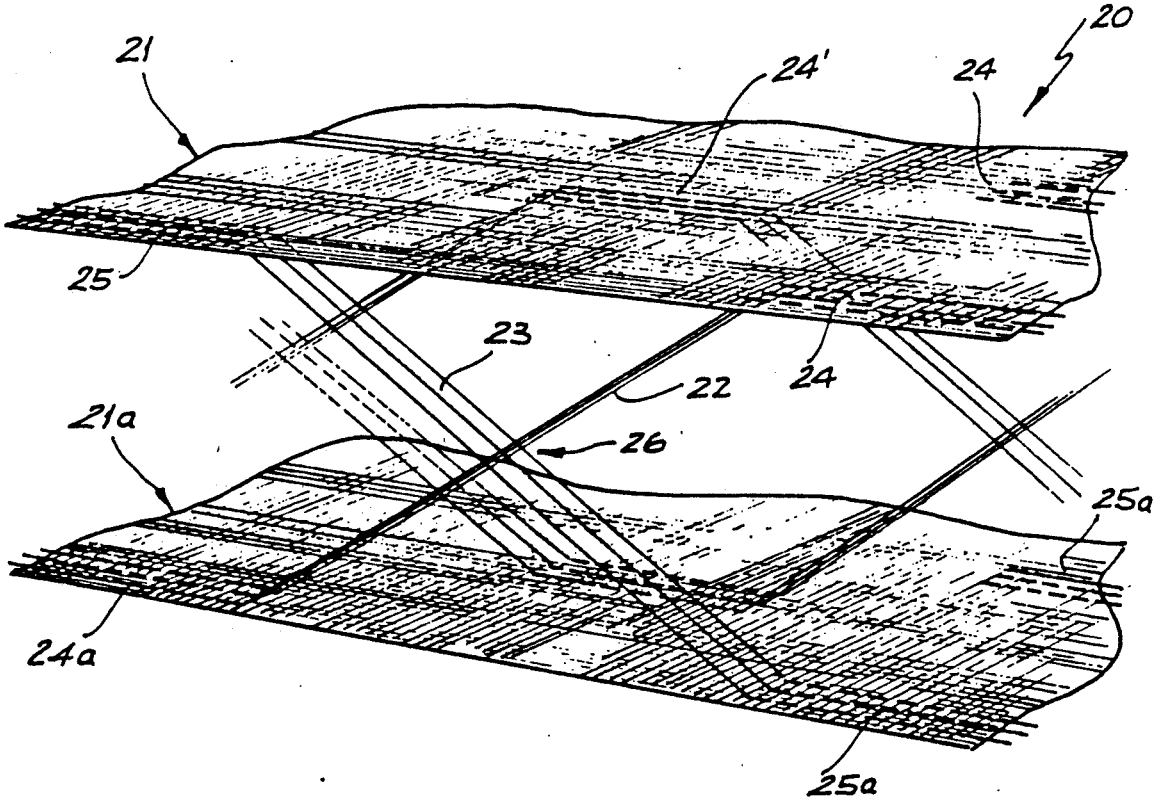
FIG. 2 is a schematic perspective view of a preferred revetment fabric illustrating the spacer threads.

In FIG. 2, the revetment fabric 20, comprises two layers, 21 and 21*a* respectively, of plastics material having two sets of six lengthwise spacer threads 22 and 23 intermittently and alternatively woven at locations 24, 25 and 24*a*, 25*a* in each respective layer. (In the drawing only three spacer threads are shown for clarity).

The individual spacer threads 22 and 23, interlink to form a scissor connection 26. This scissor connection 26 allows the two layers 21 and 21*a*, to be held apart in a range of depths. The reinforcement of the fabric by the spacer threads permits shrinkage of up to 15% in the mattress. This feature has the advantage that one size of fabric can be used in place of the previous range of fabric sizes.

Figure 3:
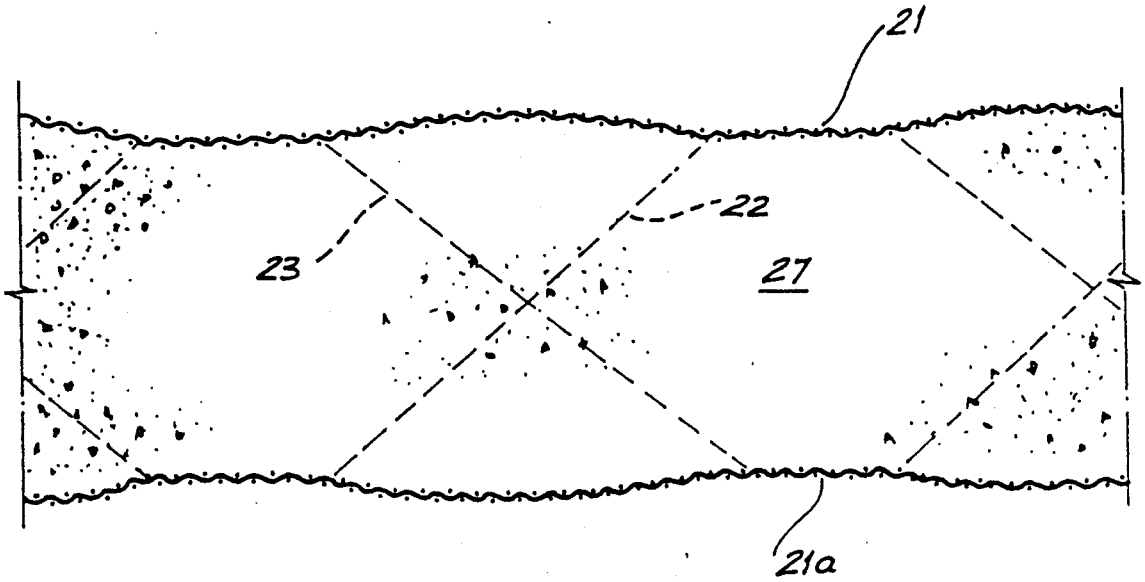
FIG. 3 is an actual cross-section view of a revetment mattress made with the preferred revetment fabric.

In FIG. 3, it can be seen that the concrete 27 is of substantially uniform thickness between the layers 21 and 21*a* of revetment fabric.

In use it was found that increasing the pressure under which concrete is pumped into the revetment fabric 20, resulted in a more linear mattress and did not give a more 'pillowed' appearance to the mattress.

Figure 4:
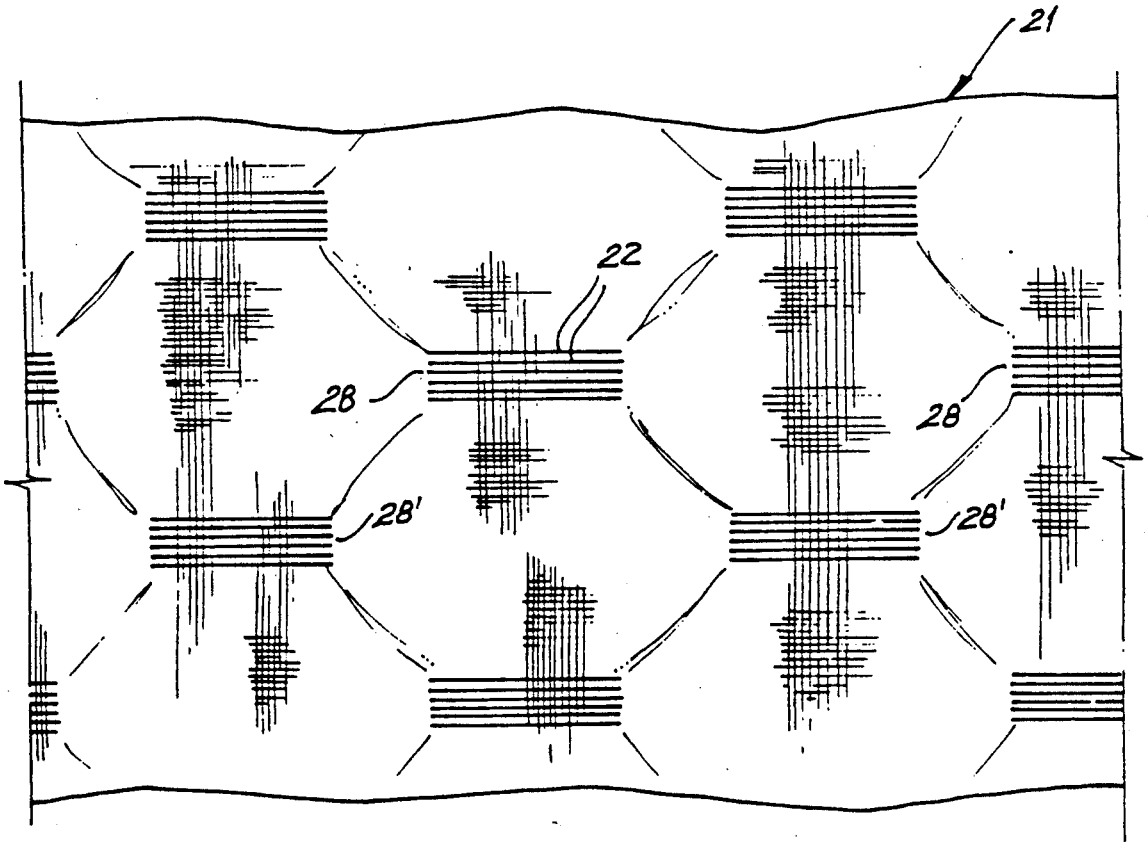
FIG. 4 shows a plan view of the revetment mattress of FIG. 3.

In FIG. 4, is shown layer 21 with a row of spacer threads 22 running lengthwise through layer 21 and woven at locations 28.

An adjacent row of space threads 22' also runs lengthwise through layer 21 but is woven at locations 28' which are staggered with respect to locations 28. In FIG. 2 the staggered location is shown as 24'.

In tests conducted, it has been consistently found that approximately 25% less concrete is used with the present invention than with known revetment fabrics.

I claim:

1. A revetment fabric comprising two layers of flexible pervious material characterised in having at least one lengthwise spacer thread intermittently and alternatively woven in each layer to form an angled connection between adjacent layers and maintain the layers in a substantially parallel relationship, wherein sets of six spacer threads are intermittently and alternatively woven in each layer so as to each form a scissor connection between adjacent layers.

2. The revetment fabric of claim 1 wherein one row of spacer threads is in a staggered relationship with each adjacent row of spacer threads.

* * * * *